US008083645B2

(12) United States Patent
Asukai et al.

(10) Patent No.: US 8,083,645 B2
(45) Date of Patent: Dec. 27, 2011

(54) INFORMATION EXCHANGING DEVICE

(75) Inventors: Masamichi Asukai, Kanagawa (JP); Mitsuru Takehara, Tokyo (JP); Takatoshi Nakamura, Kanagawa (JP); Motoyuki Takai, Tokyo (JP)

(73) Assignee: Sony Corporation, Tokyo (JP)

( * ) Notice: Subject to any disclaimer, the term of this patent is extended or adjusted under 35 U.S.C. 154(b) by 176 days.

(21) Appl. No.: 11/507,188

(22) Filed: Aug. 21, 2006

(65) Prior Publication Data

US 2007/0049462 A1 Mar. 1, 2007

(30) Foreign Application Priority Data

Aug. 26, 2005 (JP) ..... 2005-245179

(51) Int. Cl.
*A63B 71/00* (2006.01)

(52) U.S. Cl. ..... 482/8; 482/1

(58) Field of Classification Search ..... 482/1–9; 455/41.2; 702/188

See application file for complete search history.

(56) References Cited

U.S. PATENT DOCUMENTS

| | | | | |
|---|---|---|---|---|
| 2002/0022551 | A1* | 2/2002 | Watterson et al. | 482/8 |
| 2004/0102931 | A1* | 5/2004 | Ellis et al. | 702/188 |
| 2005/0197063 | A1* | 9/2005 | White | 455/41.2 |

FOREIGN PATENT DOCUMENTS

| | | | |
|---|---|---|---|
| JP | 3102841 | B2 | 10/2000 |
| JP | 2003-305146 | A | 10/2003 |
| JP | 2003-307431 | A | 10/2003 |
| JP | 3582211 | | 8/2004 |
| JP | 2005-028103 | A | 2/2005 |
| JP | 2005-038366 | A | 2/2005 |
| WO | WO 02/067449 | A2 | 8/2002 |

* cited by examiner

*Primary Examiner* — Loan Thanh
*Assistant Examiner* — Shila Jalalzadeh Abyane
(74) *Attorney, Agent, or Firm* — Wolf, Greenfield & Sacks, P.C.

(57) ABSTRACT

An information exchanging device includes a physical information measuring unit, a script executing unit, a radio communication unit, a display unit, and a control unit. The physical information measuring unit is configured to measure physical information of a user. The script executing unit is configured to execute a script of contents based on said physical information. The radio communication unit is configured to transmit and receive data to and from another device. The control unit is configured to establish a connection between the information exchanging device and the other device by said radio communication unit when the other device is present in a communicating range, receive a predetermined script via said radio communication unit from the other device to which the information exchanging device is connected, make said script executing unit execute the received script, and transmit a result of execution to the other device.

19 Claims, 6 Drawing Sheets

SCRIPT TABLE SCRTBL

| |
|---|
| SCR001 = NUMBER OF STEPS/ TARGET NUMBER OF STEPS×100 |
| SCR002 = NUMBER OF STEPS/WALK TIME |
| SCR003 = HEART RATE/(NUMBER OF STEPS/ WALK TIME) |
| ····· |

[UID00B, 98]

RESULT OF CALCULATION

USER IDENTIFYING CODE

| USER IDENTIFYING CODE | VALUE |
|---|---|
| UID00B | 98 |
| UID00C | 103 |
| UID00F | 35 |
| ··· | |

DB001(DBi) DATABASE FOR SCR001

RANKING(NUMBER OF STEPS/ TARGET NUMBER OF STEPS×100)

| | | |
|---|---|---|
| 1 | UID00C | 103 |
| 2 | UID00B | 98 |
| 3 | YOU | 95 |
| 4 | UID00H | 91 |
| ····· | | |

CONDITION TABLE USRTBL

| |
|---|
| UID00D, UID00E, ・・・・・・ |

CONDITION TABLE RSLTBL

| |
|---|
| (SCR001≦90) or (SCR001≧110)<br>・・・・・・ |

FIG. 6

CONDITION TABLE USRTBL

| USER IDENTIFYING CODE | CONDITION |
|---|---|
| (DEFAULT) | NUMBER OF STEPS |
| UID00B | HEART RATE, NUMBER OF STEPS, AND PACE OF WALK |
| UID00C | PERMIT ALL |
| UID00D | PROHIBIT ALL |
| ⋮ | ⋮ |

INFORMATION EXCHANGING DEVICE

CROSS REFERENCES TO RELATED APPLICATIONS

The present invention contains subject matter related to Japanese Patent Application JP 2005-245179 filed with the Japanese Patent Office on Aug. 26, 2005, the entire contents of which being incorporated herein by reference.

BACKGROUND OF THE INVENTION

1. Field of the Invention

The present invention relates to an information exchanging device suitable for continuing exercise.

2. Description of the Related Art

As devices for maintaining and improving health, there are devices that measure the number of steps, a pulse rate, a respiration rate and the like during exercise such as running, jogging, walking, cycling or the like in a park, for example. In addition, there are devices that calculate EPOC (Excess Post-exercise Oxygen Consumption), an amount of ventilation, an oxygen intake, an amount of energy consumption, a walking distance and the like from these pieces of measurement information. These devices are each formed as a portable type to be worn and used during exercise.

Related art documents include the following, for example.

[Patent Document 1]

Japanese Patent No. 3582211

[Patent Document 2]

Japanese Patent Laid-Open No. 2003-305146

SUMMARY OF THE INVENTION

To obtain a certain effect from sports as described above needs continuation of exercise for a substantial period of time. However, each of the devices in the past only feeds back a result of measurement or information obtained from the result of measurement to a user, and is thus unsatisfactory in terms of motivating the user to continue exercise. When the user encounters people similarly jogging for health in a park, for example, the user exchanges a slight recognition with them by eye contact or the like, which is unlikely to be an incentive to continue jogging.

In view of such points, it is desirable to provide a device that can assist in continuing exercise such as walking, jogging or the like.

According to an embodiment of the present invention, there is provided an information exchanging device including: a physical information measuring unit configured to measure physical information of a user; a script executing unit configured to execute a script of contents based on the physical information; a radio communication unit configured to transmit and receive data to and from another device; and a display unit. When the other device is present in a communicating range, the radio communication unit establishes a connection between the information exchanging device and the other device, and the script is transmitted and received between the information exchanging device and the other device to which the information exchanging device is connected. The script received by the transmission and reception is executed by the script executing unit, and a result of the execution of the script is transmitted to the other device that transmitted the script. The transmitted result of the execution of the script is received by the radio communication unit, and the received result of the execution of the script is displayed by the display unit.

According to the present invention, the user can use the conditions of exercise of another user as a reference or a target, and the user is motivated to continue exercise. In addition, the ranking is a local ranking. Consequently, the user may become number one in the local ranking, and people actually exercising around the user are rivals. Therefore the user is more strongly motivated to continue exercise, and can exercise more diligently.

BRIEF DESCRIPTION OF THE DRAWINGS

FIG. 6 is a diagram showing another form of a data table; and

DETAILED DESCRIPTION OF THE PREFERRED EMBODIMENTS

[1] Outline of Overall System

Figure 1:
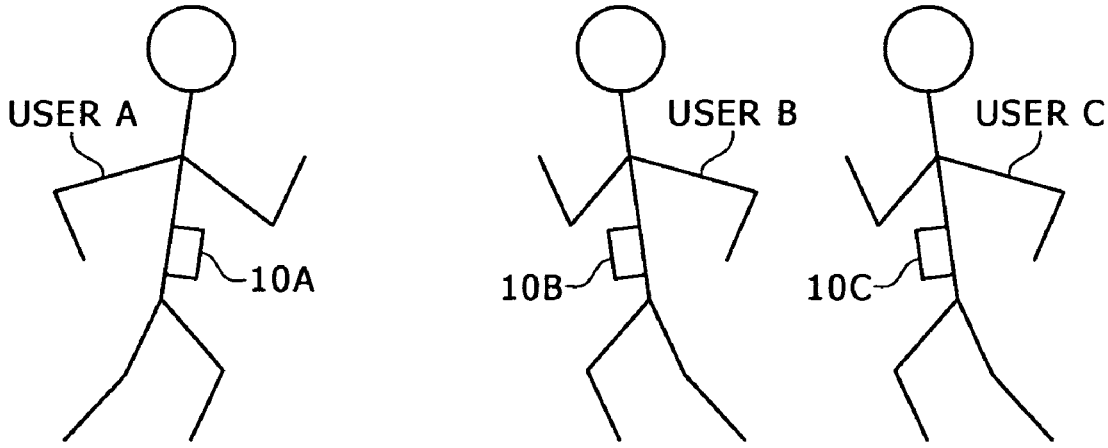
FIG. 1 is a diagram of assistance in explaining an outline of the present invention.

FIG. 1 is a schematic diagram showing an example of a state of use and a method of use of a system based on the present invention, in which diagram a jogging user A is passing by similarly jogging users B and C.

Reference numeral 10 (10A, 10B, . . . ) denotes an information exchanging device according to an embodiment of the present invention. In FIG. 1, the users A to C wear exchanging devices 10A to 10C, respectively. Though details of the exchanging device 10 and individual items will be described later, the exchanging device 10 has a function of measuring physical information such as a pulse rate, a respiration rate, brain waves, the number of steps and the like of the user wearing the exchanging device 10, and a function of communicating with another exchanging device 10.

Figures 2A, 2B, 2C, 2D, 2E:
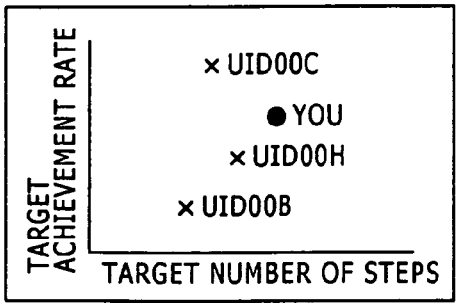
FIGS. 2A to 2E are diagrams of assistance in explaining the present invention.

Further, the exchanging device 10 has a script table SCRTBL and a user identifying code UIDj. The script table SCRTBL is obtained by tabulating scripts SCRi created by the user. An example of the script table SCRTBL is shown in FIG. 2A. FIG. 2A shows the script table SCRTBL of the exchanging device 10A, which table has scripts SCR001, SCR002, . . . (i=001, 002, . . . in SCRi). In FIG. 2A, the script SCR001 defines a rate of achievement of a walking target, while the script SCR002 defines a pace of walking.

The user identifying code UIDj is an identifying code for identifying the exchanging device 10 and the user of the exchanging device 10. Suppose in the following that the user identifying code UIDj of the exchanging device 10A is a code UID00A, the user identifying code UIDj of the exchanging device 10B is a code UID00B, . . . (j=00A, 00B, . . . in UIDj).

(1) When the user A and the user B approaches each other, and thereby the exchanging devices 10A and 10B enter a range where the exchanging devices 10A and 10B can communicate with each other by the communicating functions of the exchanging devices 10A and 10B, the exchanging device 10 transmits the script SCR001 in the first row, for example, of the script table SCRTBL to the exchanging device 10B.

(2) When receiving the script SCR001 transmitted in process (1), the exchanging device 10B calculates the contents of the script SCR001 for the user B. As a result, data "98", for example, is obtained.

(3) The exchanging device 10B transmits the identifying code UID00B of the exchanging device 10B as shown in FIG. 2B and the data "98" as a result of the calculation in process (2) to the exchanging device 10A.

(4) When receiving the data [UID00B, 98] transmitted in process (3), the exchanging device 10A stores the data [UID00B, 98] in a database DB001 for the script SCR001, as shown in a first row of FIG. 2C.

(5) Thereafter the exchanging device 10A performs a similar process for the exchanging devices 10C, 10D, . . . of other users C, D, . . . . As shown in a second row and subsequent rows of FIG. 2C, the exchanging device 10A stores data transmitted thereto in the database DB001.

(6) When the user A performs a predetermined operation on the exchanging device 10A, the exchanging device 10A sorts the contents of the database DB001, and then displays a result of the sort as a ranking as shown in FIG. 2D. Alternatively, when the user A performs another predetermined operation on the exchanging device 10A, the exchanging device 10A displays the contents of the database DB001 graphically as shown in FIG. 2E.

(7) Since the exchanging devices 10A, 10B, . . . have no master-slave relation therebetween, and are equal to each other, the exchanging device 10B performs similar processes to processes (1) to (4) for the exchanging device 10A while the exchanging device 10A is performing processes (1) to (4). The same is true for the other exchanging devices 10C, 10D, . . . .

Thus, when the collecting devices 10 approach each other to be at a distance at which the collecting devices 10 can communicate with each other, the collecting devices 10 automatically exchange data on jogging conditions of the users wearing the collecting devices 10. The exchanged data is set by the script SCRi.

The above is an outline of a state of use and a method of use of the system based on the present invention. Thus, according to the above-described system, the user A can be informed of the jogging conditions of the other users B, C, . . . , and can use the jogging conditions as a reference or a target. That is, the user A is motivated to continue jogging.

Data exchange is performed when the collecting devices 10 approach each other, that is, data exchange is performed with people that the user A meets during the usual jogging. Thus, the ranking shown in FIG. 2D or FIG. 2E is a local ranking. When the ranking shown in FIG. 2D or FIG. 2E is a local ranking, the user A may become number one in the local ranking, and people actually jogging around the user A are rivals. Therefore the user A is more strongly motivated to continue jogging, and can jog more diligently.

Further, as will be described later, the user A can define the script SCRi in FIG. 2A, or the user A can set other people with whom to exchange data. Therefore the user A can create a special ranking, and thus enjoy and continue jogging. The above is true for the other users B, C, . . . and for other exercises.

[2] Details of Each Item

Detailed description will be made below of data (information) processed by the exchanging device 10.

[2-1] Script Table SCRTBL and Script SCRi

The script table SCRTBL is a table of a collection of scripts SCRi, as described above. FIG. 2A shows an example of contents of the script table SCRTBL in the exchanging device 10A, and has equations SCR001, SCR002, . . . as the scripts SCRi. The defined contents of the scripts SCRi can be arbitrarily described by the user by a predetermined script language.

The script SCR001 in the first row of the script table SCRTBL in FIG. 2A defines a ratio between the number of steps of another user on whom to collect information and the number of steps set as a target by the other user as a rate of achievement of the walking target. The script SCR002 in the second row of the script table SCRTBL in FIG. 2A defines a ratio between the number of steps of the other user on whom to collect information and a time taken for jogging or walking by the other user as a pace of walking.

Since the contents of the script SCRi can be arbitrarily set by the user, a correspondence between the number i (left side) and the described contents (right side) of the script SCRi, the number of scripts SCRi, and the like generally differ between the exchanging devices 10. Incidentally, a script SCRi having basic or common contents such as the script SCR001 may be provided in advance in the script table SCRTBL by a manufacturer of the exchanging devices 10.

The script can also be described as a combination of information based on the exercise of the other user and information based on the exercise of the own self, such for example as

*SCR*123=Pace of Walking of Other Person/Pace of Walking of Own Self.

In this case, when data (the pace of walking of the other person) is received from the exchanging device 10 of the other person, it suffices to calculate the contents of the script from the received data and data (the pace of walking of the own self) on the own self which data is processed by the exchanging device 10 of the own self, and thereby produce a result.

When a plurality of scripts SCRi are provided in the script table SCRTBL, a script SCRi to be transmitted to the exchanging device 10 of the other person in process (1) is selected by the user in advance. At this time, it is also possible to select a plurality of scripts SCRi, and transmit the plurality of scripts SCRi to the exchanging device 10 of the other person.

[2-2] User Identifying Code UIDj

User identifying codes UIDj are information for the exchanging devices 10 to identify each other. Thus, the user identifying codes UIDj are values unique to the respective exchanging devices 10, and are given by the manufacturer of the exchanging devices 10.

[2-3] Database DBi

The database DB001 and the script SCR001 provided in the script table SCRTBL form a pair. When the second script SCR002 is present in the script table SCRTBL, a database DB002 is provided to form a pair to the second script SCR002. That is, for each script SCRi provided in the script table SCRTBL, a database DBi is provided to form a pair to the script SCRi.

When a script SCRi is transmitted to another exchanging device 10, and thereby data (a result of calculation in process (2)) and a user identifying code UIDj are returned, the calculation result and the user identifying code UIDj are stored in the database DBi forming a pair to the transmitted script SCRi, as shown in FIG. 2C.

[2-4] Condition Tables USRTBL and RSLTBL

When two exchanging devices 10 and 10 become able to communicate with each other, data is exchanged as in processes (1) to (4). However, data of other users may not be needed. For example, when a target achievement rate defined in the script SCR001 in FIG. 2A is extremely low, the data of the target achievement rate is often unnecessary. Alternatively, when there is a user whose target achievement rate is extremely high, and a ranking as shown in FIG. 2D is displayed, a possibility of the own self ranking high is reduced, and therefore energy to continue jogging may be reduced.

Figures 3A, 3B, 4:
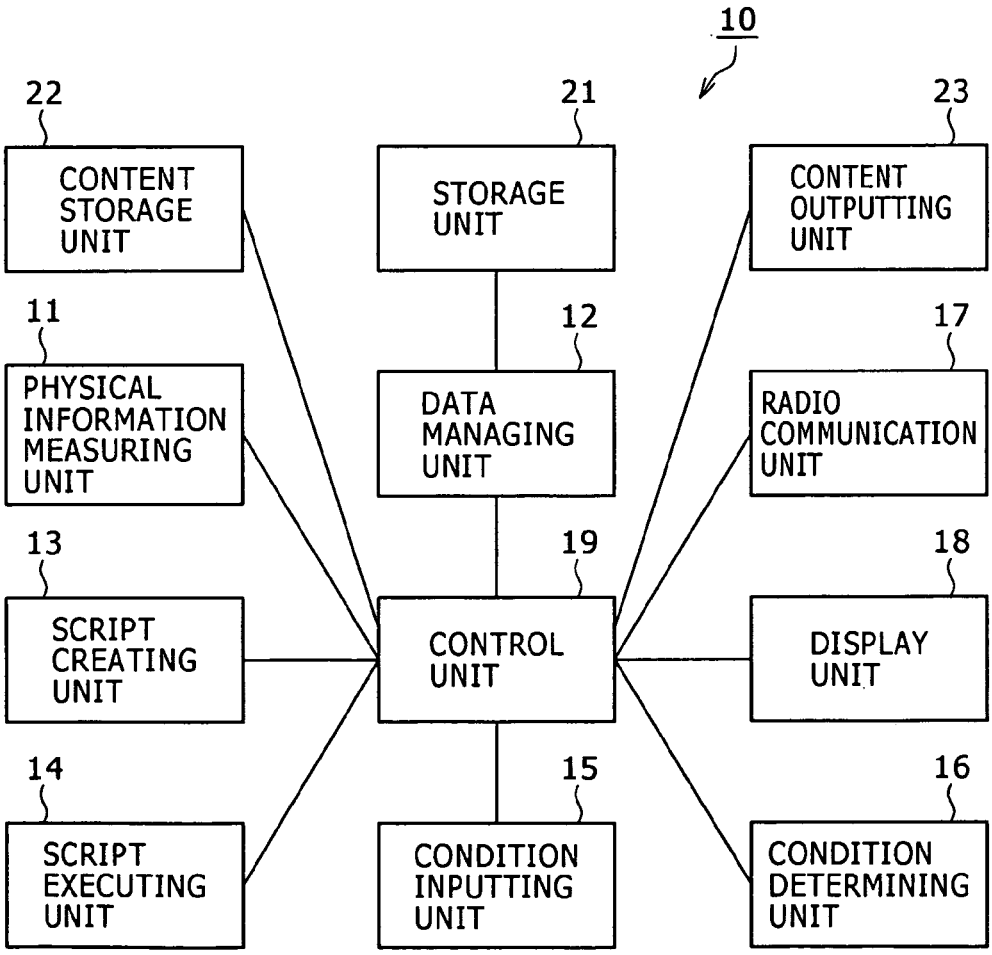
FIGS. 3A and 3B are diagrams each showing one form of a data table.
FIG. 4 is a schematic diagram showing one form of the present invention.

In order to deal with such a case, the exchanging device 10 is provided with condition tables USRTBL and RSLTBL as shown in FIGS. 3A and 3B, for example. The condition tables USRTBL and RSLTBL show conditions when data is exchanged. The condition tables USRTBL and RSLTBL in FIGS. 3A and 3B show conditions for refusing data exchange. The condition table USRTBL in FIG. 3A indicates that data is not exchanged with users having user identifying codes UID00D and UID00E, that is, shows other users with whom data is not exchanged. The condition table RSLTBL in FIG. 3B indicates that data is not exchanged with other people whose data calculated by the script SCR001 (result of calculation) is 90 or less or 110 or more, that is, shows other users with whom data is not exchanged depending on the result of calculation of the script SCRi.

[3] Details of Information Exchanging Device 10

[3-1] Configuration Example

FIG. 4 shows an example of configuration of an information exchanging device 10 according to an embodiment of the present invention. The exchanging device 10 has a physical information measuring unit 11 and a data managing unit 12. The physical information measuring unit 11 measures physical information such as a pulse rate, a respiration rate, perspiration, myoelectric waves, movement, the number of steps and the like of a user wearing the exchanging device 10. The data managing unit 12 has a storage unit 21. The data managing unit 12 stores and manages the script table SCRTBL, the database DBi, and the condition tables USRTBL and RSLTBL as well as data measured by the physical information measuring unit 11 and the like.

The exchanging device 10 further includes a script creating unit 13 and a script executing unit 14. The script creating unit 13 is a user interface for creating a script SCRi according to items measured by the physical information measuring unit 11. The data managing unit 12 registers the created script SCRi in the script table SCRTBL in the storage unit 21. The script executing unit 14 executes a script SCRi when the script SCRi is transmitted from another exchanging device 10. Incidentally, measurement data necessary to execute the script SCRi is extracted from the storage unit 21 by the data managing unit 12, and then used.

The exchanging device 10 further includes a condition inputting unit 15 and a condition determining unit 16. The condition inputting unit 15 is a user interface for inputting conditions for determining whether to exchange data with other exchanging devices 10. The conditions input by the condition inputting unit 15 are registered in the condition tables USRTBL and RSLTBL in the storage unit 21.

The condition determining unit 16 refers to the condition tables USRTBL and RSLTBL in the storage unit 21 when a script SCRi and a user identifying code UIDj are transmitted from another exchanging device 10, and determines whether the other exchanging device 10 is appropriate as another device with which to exchange data. Incidentally, when a result of the determination indicates that the other exchanging device 10 is appropriate as another device with which to exchange data, process (3) is performed. When the other exchanging device 10 is not appropriate as another device with which to exchange data, communication is ended.

The exchanging device 10 further includes a radio communication unit 17, a display unit 18, and a control unit 19. The radio communication unit 17 establishes a connection with the radio communication units 17 of adjacent exchanging devices 10 by broadcast to perform transmission and reception in processes (1) and (3). The radio communication unit 17 is implemented by Bluetooth, for example. The display unit 18 makes displays of FIGS. 2D and 2E, displays a user exercise result, and makes a display at a time of input of user information. The control unit 19 is formed with a microcomputer. The control unit 19 controls the whole of the exchanging device 10 and the parts 11 to 18. The control unit 19 performs a process of communication with another exchanging device 10 by a procedure to be described in the following.

[3-2] Example of Signal Processing (1)

Figure 5:
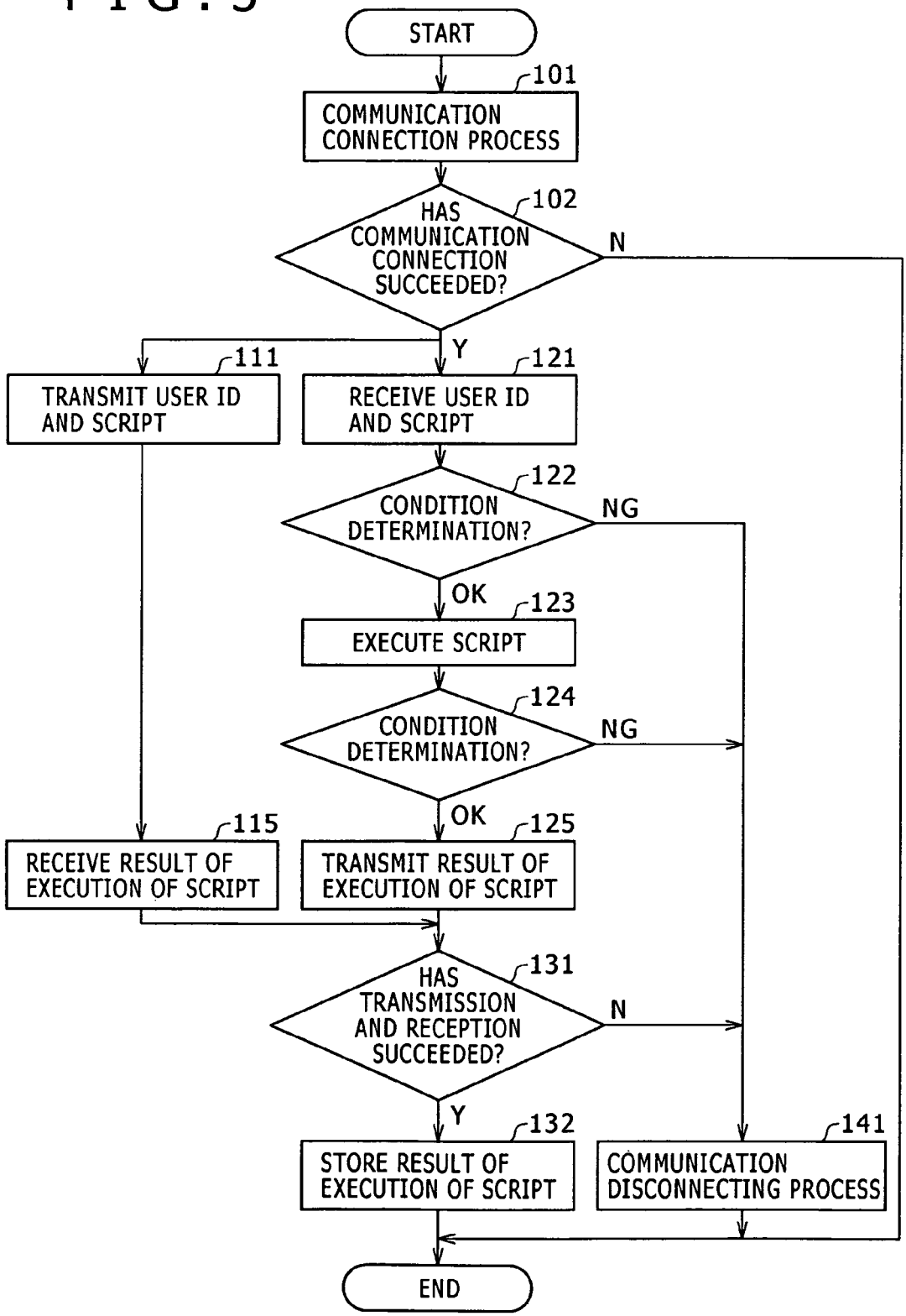
FIG. 5 is a flowchart of one form of a process flow according to the present invention.

FIG. 5 shows a process flow when processes (1) to (4) are performed with another exchanging device 10. In step 101, a process for connection with the radio communication unit 17 of an adjacent exchanging device 10 by broadcast is performed. In step 102, whether the connection process has succeeded is determined.

When the connection process has succeeded, steps 111 and 115 and steps 121 to 125 are performed in parallel with each other by multitasking. Specifically, in step 111, the user identifying code UIDj of an own device and a script SCRi selected in advance are transmitted to the other exchanging device 10. In next step 115, the exchanging device 10 waits for a result of execution of the script SCRi transmitted in step 111. When a user identifying code UIDj and a result of execution of the script SCRi are transmitted from the other exchanging device 10, and are received by the exchanging device 10, or when a time-out period for reception has passed, the process proceeds from step 115 to step 131.

Meanwhile, when the other exchanging device 10 performs step 111 and thereby transmits the user identifying code UIDj and a script SCRi, the user identifying code UIDj and the script SCRi are received in step 121. In step 122, whether the user identifying code UIDj received in step 121 is included in the condition table USRTBL is determined. When the user identifying code UIDj received in step 121 is not included in the condition table USRTBL, that is, when data exchange with the other exchanging device 10 is permitted, the process proceeds to step 123. In step 123, the script SCRi received in step 121 is executed.

Next, in step 124, whether a result of the execution in step 123 satisfies the conditions in the condition table RSLTBL is determined. When the result of the execution in step 123 does not satisfy the conditions in the condition table RSLTBL, that is, when the execution result is permitted to be transmitted in data exchange, the process proceeds to step 125. In step 125, the user identifying code UIDj of the own device and the result of execution of the script SCRi are transmitted to the other exchanging device 10. The process thereafter proceeds to step 131. Incidentally, the user identifying code UIDj and the result of execution of the script SCRi transmitted in step 125 are received in step 115 of the other exchanging device 10.

In step 131, whether data exchange with the other exchanging device 10 has succeeded is determined. When data exchange with the other exchanging device 10 has succeeded, the process proceeds to step 132. In step 132, the user identifying code UIDj of the other exchanging device 10 and the result of execution of the script SCRi received in step 115 are registered in a database DBi (FIG. 2C) corresponding to the script SCRi. The process at the time of data exchange is then ended.

Incidentally, when it is determined that data exchange has failed in step 131, the process proceeds to step 141, where a communication for which the connection is established in step 101 is disconnected, and then the process is ended. Also, when it is determined in step 122 that the user identifying code UIDj is included in the condition table USRTBL, and when it is determined in step 124 that the result of the execution satisfies the conditions in the condition table RSLTBL, that is, when the exchanging of the data is not permitted, the process proceeds to step 141, where the communication for which the connection is established in step 101 is disconnected, and then the process is ended. When the connection process has failed in step 102, the process is ended directly.

The result of execution of the script SCRi registered in the database DBi is sorted when a predetermined operation is performed by a user, and displayed in a ranking format or in a graphical manner, as described above in process (6) (as shown in FIG. 2D or 2E, for example).

Since data exchange is performed as described above, the user can use the conditions of exercise of another user as a reference or a target, and the user is motivated to continue exercise.

In addition, since data exchange is performed with people that the user meets during the usual exercise, the ranking shown in FIG. 2D or FIG. 2E is a local ranking. Consequently, the user may become number one in the local ranking, and people actually exercising around the user are rivals. Therefore the user is more strongly motivated to continue exercise, and can exercise more diligently.

Further, since a script SCRi in the script table SCRTBL can be not only provided by the manufacturer but also defined by the user, or since other users with whom to exchange data can be selected by the condition tables USRTBL and RSLTBL, the user can create a special ranking, and thus enjoy and continue exercise.

Further, the physical information itself measured by the physical information measuring unit 11 is not exchanged with other users, that is, the physical information is not disclosed to other users.

The information exchanging device may further include a content data storage unit (22) for storing content data and a content outputting unit (23) for outputting content data. When the information exchanging device includes the content data storage unit and the content outputting unit, the information exchanging device can reproduce musical piece data, and receive a result of execution of a script from another device while outputting the musical piece data being reproduced from earphones. In this case, it is possible not only to display the execution result received from the other device on the display unit, but also to notify the execution result to the user by voice via the earphones serving as the outputting unit. Thus notifying the execution result to the user by voice enables the user to grasp the execution result of the other device surely and easily even when exercising while listening to musical piece data. Incidentally, the content data includes not only content data stored in the content storage unit of the information exchanging device, but also content data received from content providing servers and other devices via the radio communication unit.

[3-3] Example of Signal Processing (2)

While the condition table USRTBL in FIG. 3A defines only whether to exchange the data of a result of execution of a script SCRi, a condition table USRTBL shown in FIG. 6 defines whether to exchange the data of a result of execution of a script SCRi as well as whether to exchange the data of physical information measured by the physical information measuring unit 11.

Specifically, in the case of the condition table USRTBL in FIG. 6, exchange of the data of the number of steps with all other users is permitted by default. Data exchange of the number of steps by default and a heart rate and a pace of walking is permitted with a user having the user identifying code UID00B; data exchange of all the physical information is permitted with a user having the user identifying code UID00C; and data exchange of all the physical information (including the number of steps by default) is refused with a user having the user identifying code UID00D.

Figure 7:
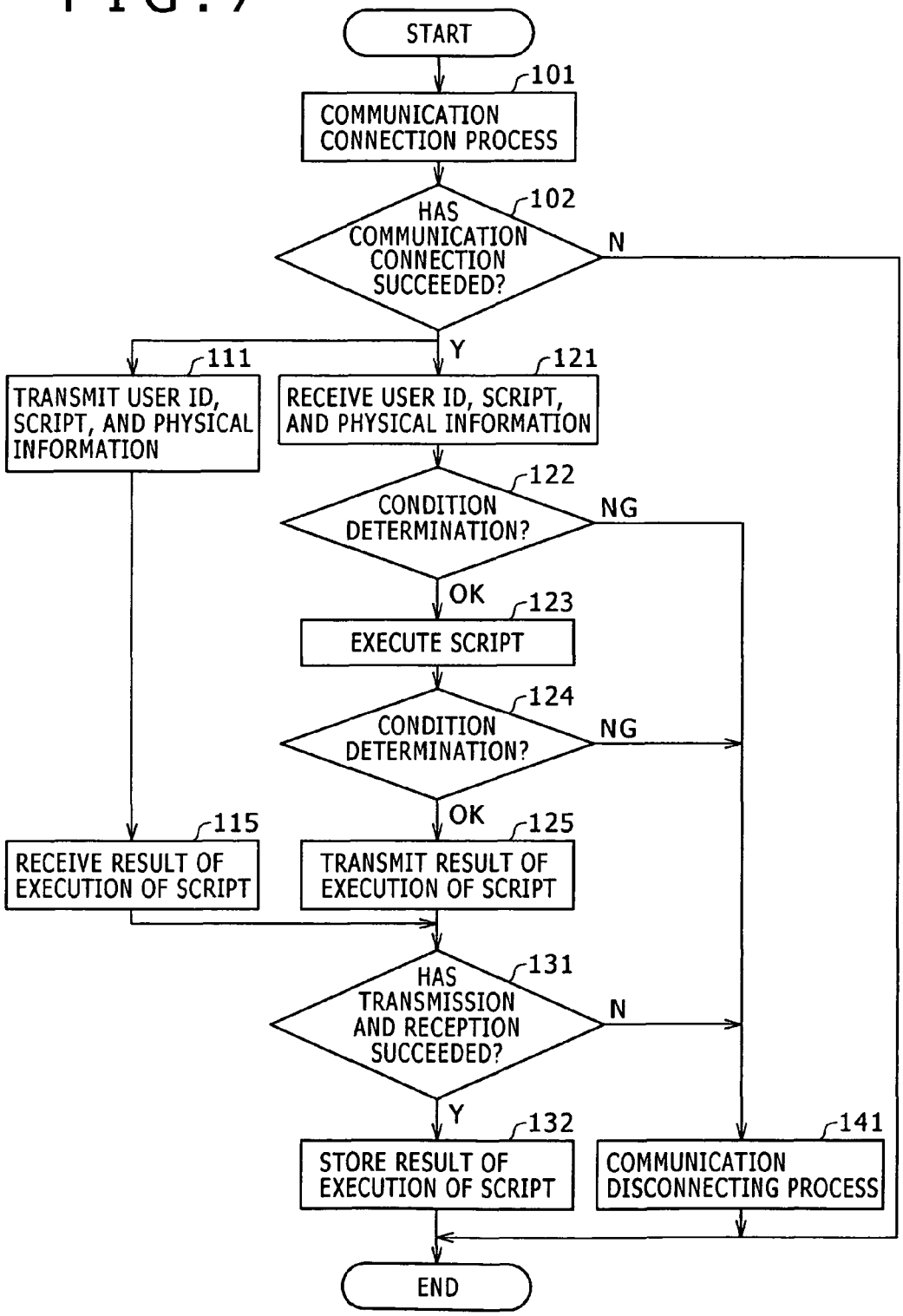
FIG. 7 is a flowchart of another form of a process flow according to the present invention.

Accordingly, in the case of the condition table USRTBL, a process flow when communication is performed with another exchanging device 10 is as shown in FIG. 7, for example. Specifically, a basic process is the same as in FIG. 5, physical information measured by the physical information measuring unit 11 in addition to a user identifying code UIDj and a script SCRi is transmitted to the other exchanging device 10 in step 111.

In step 121 of the own device, a user identifying code UIDj, a script SCRi, and physical information transmitted in step 111 of the other exchanging device 10 are received. In step 122, physical information that may be transmitted in data exchange is determined from the user identifying code UIDj received in step 121 and the condition table USRTBL of FIG. 6. The physical information that may be transmitted in data exchange and a result of execution of the script SCRi are transmitted to the other exchanging device 10 in step 125.

Thus, in this example, exercise condition information and physical information selected in advance can be exchanged. In addition, the physical information to be exchanged can be set for each of other devices.

[4] Others

The tables USRTBL and RSLTBL in FIGS. 3A and 3B can be tables indicating data exchange permitting conditions. In addition, a script SCRi may be provided in advance by the manufacturer of the exchanging device 10. Further, the condition tables USRTBL and RSLTBL may be omitted to exchange data with all other users.

It should be understood by those skilled in the art that various modifications, combinations, sub-combinations and alterations may occur depending on design requirements and other factors insofar as they are within the scope of the appended claims or the equivalents thereof.

What is claimed is:

1. An information exchanging system, comprising:

a first information exchanging device, wherein the first information exchanging device comprises:

a physical information measuring unit configured to measure physical information of a first user carrying the first information exchanging device;

a script executing unit configured to execute a script having one or more executable contents based on said measured physical information;

a radio communication unit configured to transmit data to and receive data from a second information exchanging device carried by a second user, wherein a position of the second user relative to the first user changes over time; and a control unit configured to automatically exchange data with the second information exchanging device via said radio communication unit when the second information exchanging device is present in a communicating range, receive a first set of one or more executable contents via said radio communication unit from the second information exchanging device to which the first information exchanging device is connected, make said script executing unit execute the first set of one or more executable contents and transmit a result of execution of the first set of one or more executable contents to the second information exchanging device, wherein the first set of one or more executable contents received from the second information exchanging device comprises executable contents including at least one formula for calculating at least one value regarding a physical condition of the first user, and wherein the result of execution comprises the at least one value calculated according to the at least one formula based on the measured physical information.

2. The information exchanging system as claimed in claim 1, wherein the first information exchanging device further comprises a display unit, wherein said control unit establishes a connection between the first information exchanging device and the second information exchanging device by said radio communication unit when the second information exchanging device is present in a communicating range, transmits a second set of one or more executable contents to the second information exchanging device to which the first information exchanging device is connected, makes said radio communication unit receive a result of execution of the second set of one or more executable contents by the second information exchanging device, and makes said display unit display the received result of the execution of the second set of one or more executable contents by the second information exchanging device.

3. The information exchanging system as claimed in claim 1, wherein executing the first set of one or more executable contents comprises accessing one or more types of physical information data, and wherein said control unit makes said script executing unit execute the first set of one or more executable contents only when permission to exchange data of the one or more types between the first information exchanging device and the second information exchanging device is set in advance.

4. The information exchanging system as claimed in claim 3, wherein said control unit verifies the permission to exchange data between the first information exchanging device and the second information exchanging device on a basis of identifying information for identifying the second information exchanging device.

5. The information exchanging system as claimed in claim 2, wherein said control unit stores the received result of the execution of the second set of one or more executable contents by the second information exchanging device in a storage unit, then sorts a plurality of results stored on the storage unit, and displays the sorted plurality of results in a ranking format on said display unit.

6. The information exchanging system as claimed in claim 5, wherein the plurality of results comprises a result of execution of the second set of one or more executable contents by the script executing unit.

7. The information exchanging system as claimed in claim 1, wherein the first information exchanging device further comprises:

a creating unit configured to create a set of one or more executable contents on a basis of an operation by the first user.

8. The information exchanging system as claimed in claim 1, wherein the first set of one or more executable contents comprises contents including at least one formula for calculating a rate of achievement of a target and/or a pace of walking.

9. The information exchanging system as claimed in claim 2, wherein the first information exchanging device further comprises:

an output unit configured to output content data, wherein said control unit outputs said result of the execution of the second set of one or more executable contents by the second information exchanging device as sound from said output unit.

10. An information exchanging method performed by a first device to exchange information with a second device by radio communication, said information exchanging method comprising:

measuring physical information of a first user carrying the first device;

automatically exchanging data with the second device via said radio communication when the second device is present in a communicating range, wherein the second device is carried by a second user whose position relative to the first user changes over time;

receiving a first set of one or more executable contents from the second device;

executing the first set of one or more executable contents; and transmitting a result of execution of said first set of one or more executable contents to the second device, wherein the first set of one or more executable contents received from the second device comprises executable contents including at least one formula for calculating at least one value regarding a physical condition of the first user, and wherein the result of execution comprises the at least one value calculated according to the at least one formula based on the measured physical information.

11. The information exchanging method as claimed in claim 10, wherein a connection with the second device is established by said radio communication when the second device is present in a communicating range, a second set of one or more executable contents is transmitted to the second device with which the connection is established, a result of execution of said second set of one or more executable contents by the second device is received by said radio communication, and the received result of the execution of the second set of one or more executable contents by the second device is displayed on a display unit.

12. The information exchanging method as claimed in claim 10, wherein:

whether said second device is a permissible device set in advance is determined, and said first set of one or more executable contents is executed only when the second device is determined to be a permissible device set in advance.

13. The information exchanging method as claimed in claim 12, wherein the second device from which said first set of one or more executable contents is received is identified on a basis of identifying information for identifying the second device.

14. The information exchanging method as claimed in claim 11, wherein:

the received result of the execution of the second set of one or more executable contents by the second device is stored in a storage unit, and then a plurality of results stored on the storage unit is sorted, and the plurality of sorted results are displayed in a ranking format on said display unit.

15. The information exchanging method as claimed in claim 14, wherein the plurality of results comprises a result of execution of the second set of one or more executable contents by the first device.

16. The information exchanging method as claimed in claim 11, wherein:

a set of one or more executable contents is created on a basis of an operation by the first user, when the second device is present in a communicating range, a connection with the second device is established by said radio communication, and the created set of one or more executable contents is transmitted to the second device with which the connection is established.

17. The information exchanging method as claimed in claim 10, wherein said first set of one or more executable contents comprises contents including at least one formula for calculating a rate of achievement of a target and/or a pace of walking.

18. The information exchanging method as claimed in claim 11, wherein said received result of the execution of the second set of one or more executable contents by the second device is output as sound.

19. An information exchanging system in which information is exchanged by radio communication, said information exchanging system comprising:

a first information exchanging device carried by a first user; and a second information exchanging device carried by a second user, wherein a position of the second user relative to the first user changes over time, wherein said first information exchanging device includes:

a first radio communication unit configured to transmit data to and receive data from said second information exchanging device; and a first control unit configured to automatically exchange data with said second information exchanging device via said first radio communication unit when said second information exchanging device is present in a communicating range, make said first radio communication unit transmit a set of one or more executable contents to said second information exchanging device to which said first information exchanging device is connected, and make said first radio communication unit receive a result of execution of said set of one or more executable contents from said second information exchanging device, and said second information exchanging device includes:

a physical information measuring unit configured to measure physical information of the second user;

an executing unit configured to execute one or more executable contents based on said measured physical information;

a second radio communication unit configured to transmit data to and receive data from said first information exchanging device; and a second control unit configured to automatically exchange data with said first information exchanging device via said second radio communication unit when said first information exchanging device is present in a communicating range, make said second radio communication unit receive said set of one or more executable contents from said first information exchanging device to which said second information exchanging device is connected, make said executing unit execute the received set of one or more executable contents, and then transmit said result of execution of said set of one or more executable contents to said first information exchanging device, wherein the first set of one or more executable contents received from the first information exchanging device comprises executable contents including at least one formula for calculating at least one value regarding a physical condition of the first user, and wherein the result of execution comprises the at least one value calculated according to the at least one formula based on the measured physical information.

* * * * *